US010078988B2

(12) United States Patent
Kim et al.

(10) Patent No.: US 10,078,988 B2
(45) Date of Patent: Sep. 18, 2018

(54) DISPLAY APPARATUS, DISPLAY CONTROL METHOD, AND DISPLAY METHOD

(71) Applicant: Samsung Display Co., Ltd., Yongin-si, Gyeonggi-Do (KR)

(72) Inventors: Kiseo Kim, Yongin (KR); Geebum Kim, Yongin (KR); Chanyoung Park, Yongin (KR); Jaekyoung Kim, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 125 days.

(21) Appl. No.: 14/802,610

(22) Filed: Jul. 17, 2015

(65) Prior Publication Data

US 2016/0071470 A1 Mar. 10, 2016

(30) Foreign Application Priority Data

Sep. 5, 2014 (KR) ..... 10-2014-0119382

(51) Int. Cl.
*G09G 3/20* (2006.01)
*G09G 3/36* (2006.01)
(Continued)

(52) U.S. Cl.
CPC ..... *G09G 3/3607* (2013.01); *G09G 5/02* (2013.01); *G09G 5/10* (2013.01);
(Continued)

(58) Field of Classification Search
CPC ..... G09G 5/10; G09G 3/3607; G09G 3/2003–3/2096
See application file for complete search history.

(56) References Cited

U.S. PATENT DOCUMENTS 7,333,117 B2 * 2/2008 Kim ..... H04N 9/68 345/549
8,345,338 B2 * 1/2013 Jeong ..... H04N 9/68 359/222.1
(Continued)

FOREIGN PATENT DOCUMENTS

EP 2175414 A1 4/2010
JP 2011-191620 A 9/2011
(Continued)

OTHER PUBLICATIONS

European Search Report issued by the European Patent Office dated Nov. 10, 2015 in the examination of the European Patent Application No. 15183794.5 which corresponds to present U.S. Application.
(Continued)

*Primary Examiner* — Hang Lin
(74) *Attorney, Agent, or Firm* — H.C. Park & Associates, PLC

(57) ABSTRACT

A display apparatus, a display control apparatus, and a display method are disclosed. The display apparatus includes data receiving unit receiving data; driving mode unit receiving dyschromatopsia information and determining a general driving mode or a dyschromatopsia correction driving mode; data converting unit generating corrected data by converting the data based on the dyschromatopsia information; memory storing a reference grayscale for general driving mode and at least one correction grayscales for dyschromatopsia correction driving mode; data signal output unit selecting a grayscale based on the dyschromatopsia information from among the reference grayscale or the at least one correction grayscales; and outputting a data signal corresponding to the data or the corrected data based on the
(Continued)

selected grayscale, and a light emissive device receiving the data signal to emit light with a corresponding brightness.

21 Claims, 6 Drawing Sheets

(51) Int. Cl.
*G09G 5/02* (2006.01)
*G09G 5/10* (2006.01)

(52) U.S. Cl.
CPC ..... *G09G 2320/0242* (2013.01); *G09G 2320/0613* (2013.01); *G09G 2320/0626* (2013.01); *G09G 2320/0666* (2013.01); *G09G 2320/0673* (2013.01); *G09G 2340/06* (2013.01); *G09G 2354/00* (2013.01)

(56) References Cited

U.S. PATENT DOCUMENTS 8,422,071 B2 * 4/2013 Shimamura ..... A61F 9/08 358/1.9
2002/0008684 A1 * 1/2002 Udo ..... G09G 3/2011 345/89
2004/0212815 A1 * 10/2004 Heeman ..... G06T 11/001 358/1.9
2005/0105796 A1 * 5/2005 Hong ..... G06T 11/001 382/162
2005/0134800 A1 * 6/2005 Kim ..... H04N 9/68 351/242
2006/0071938 A1 * 4/2006 Richardson ..... G09G 5/02 345/591
2006/0274217 A1 12/2006 Bae et al.
2008/0278521 A1 * 11/2008 Kang ..... G09G 3/2003 345/690
2010/0265281 A1 * 10/2010 Furukawa ..... G09G 3/3413 345/691
2012/0147163 A1 * 6/2012 Kaminsky ..... G09G 5/028 348/62
2013/0241970 A1 9/2013 Lee et al.
2013/0335435 A1 * 12/2013 Ambrus ..... G06T 19/20 345/589
2013/0341562 A1 * 12/2013 Burdeniuc ..... C08G 18/092 252/183.13
2013/0342562 A1 * 12/2013 Shintani ..... G09G 5/028 345/593
2014/0015850 A1 * 1/2014 Ahn ..... H04N 1/60 345/594
2015/0348503 A1 * 12/2015 Woo ..... G09G 5/06 345/604

FOREIGN PATENT DOCUMENTS

KR 10-2005-0044114 A 5/2005
KR 10-2006-0124985 A 12/2006
KR 10-2007-0099969 A 10/2007
KR 10-2013-0105057 A 9/2013
KR 10-2014-0008977 A 1/2014

OTHER PUBLICATIONS

Ruchi Kulshrestha et al., "Removal of Color Blindness using Threshold and Masking", International Journal of Advanced Research in Computer Science and Software Engineering, Jun. 2013, vol. 3, Issue 6, pp. 218-221, XP055224671, India, WEB.
The extended European search report issued by the European Patent Office dated Feb. 25, 2016, in connection with European Patent Application No. 15183794.5.
Shin et al., Efficacy of the Computer Program to Compensate Color Vision Deficiency using Seohan Computerized 85-Hue Test, J Korean Ophthalmol Soc 47(10) p. 1638-1646 (2006).
Yang et al., Improving Visual Accessibility for Color Vision Deficiency Based on MPEG-21, ETRI Journal, vol. 26, No. 3, (2004).
Ingung et al., Orthogonal Combination of the Three Visual Channels, Vision Research, vol. 17, Issue 9, 1977, pp. 1075-1082.

* cited by examiner

FIG. 2

| DYSCHROMATOPSIA DEGREES | PROTANOMALY | | | DEUTERANOMALY | | |
|---|---|---|---|---|---|---|
| | R | G | B | R | G | B |
| 0.0000 | 1.000 | 0.000 | 0.000 | 1.000 | 0.000 | 0.000 |
| | 0.000 | 1.000 | 0.000 | 0.000 | 1.000 | 0.000 |
| | 0.000 | 0.000 | 1.000 | 0.000 | 0.000 | 1.000 |
| 0.1000 | 1.176 | −0.224 | 0.048 | 1.167 | −0.221 | 0.054 |
| | −0.036 | 1.054 | −0.018 | −0.062 | 1.077 | −0.015 |
| | 0.003 | 0.001 | 0.996 | 0.004 | −0.009 | 1.004 |
| 0.2000 | 1.398 | −0.509 | 0.111 | 1.374 | −0.495 | 0.121 |
| | −0.079 | 1.117 | −0.037 | −0.140 | 1.175 | −0.035 |
| | 0.006 | 0.002 | 0.991 | 0.010 | −0.019 | 1.009 |
| 0.3000 | 1.685 | −0.880 | 0.195 | 1.639 | −0.843 | 0.204 |
| | −0.131 | 1.192 | −0.060 | −0.243 | 1.305 | −0.062 |
| | 0.009 | 0.004 | 0.987 | 0.018 | −0.031 | 1.014 |
| 0.4000 | 2.071 | −1.381 | 0.310 | 1.991 | −1.304 | 0.313 |
| | −0.198 | 1.286 | −0.088 | −0.382 | 1.482 | −0.100 |
| | 0.012 | 0.005 | 0.982 | 0.028 | −0.047 | 1.019 |
| 0.5000 | 2.614 | −2.090 | 0.476 | 2.481 | −1.945 | 0.464 |
| | −0.288 | 1.410 | −0.122 | −0.579 | 1.734 | −0.156 |
| | 0.014 | 0.008 | 0.978 | 0.042 | −0.069 | 1.026 |
| 0.6000 | 3.433 | −3.162 | 0.729 | 3.213 | −2.900 | 0.687 |
| | −0.417 | 1.587 | −0.170 | −0.877 | 2.118 | −0.242 |
| | 0.016 | 0.011 | 0.973 | 0.064 | −0.100 | 1.036 |
| 0.7000 | 4.803 | −4.962 | 1.158 | 4.429 | −4.484 | 1.055 |
| | −0.627 | 1.870 | −0.243 | −1.378 | 2.765 | −0.388 |
| | 0.016 | 0.017 | 0.967 | 0.101 | −0.150 | 1.049 |
| 0.8000 | 7.552 | −8.579 | 2.028 | 6.856 | −7.640 | 1.784 |
| | −1.037 | 2.417 | −0.380 | −2.385 | 4.071 | −0.686 |
| | 0.011 | 0.028 | 0.961 | 0.175 | −0.249 | 1.074 |
| 0.9000 | 15.812 | −19.468 | 4.656 | 14.124 | −17.085 | 3.961 |
| | −2.247 | 4.020 | −0.772 | −5.420 | 8.009 | −1.589 |
| | −0.009 | 0.061 | 0.949 | 0.398 | −0.541 | 1.144 |

DISPLAY APPARATUS, DISPLAY CONTROL METHOD, AND DISPLAY METHOD

CLAIM OF PRIORITY

This application claims the priority of and all the benefits accruing under 35 U.S.C. § 119 of Korean Patent Application No. 10-2014-0119382, filed on Sep. 5, 2014, in the Korean Intellectual Property Office (KIPO), the disclosure of which is incorporated herein in its entirety by reference.

BACKGROUND OF THE INVENTION

1. Field of Disclosure

One or more exemplary embodiments relate to a display apparatus, a display control apparatus, and a display method, and more particularly to, a display apparatus, a display control apparatus, and a display method that use a self-emission device.

2. Description of the Related Art

In general, color blindness is the inability to perceive color differences due to inherited deficiencies of cone cells in the retina or acquired damage of the cone cells or vision path deficiencies. Trichromats (people with normal vision) perceive combinations of the three primary colors (red, green, and blue). Dyschromatopsia refers to a disorder when one of three cone pigments of red, green, and blue is incomplete. Achromatopsia refers to a disorder when only two of the three cone pigments are present.

Protanomaly has a greatly reduced ability of discriminating red and green and perceives a darkening red rather than normal. Deuteranomaly has a slightly reduced ability of discriminating red and green but is known to have a same perception level of brightness as that of trichromats. Complete achromatopsia refers to a disorder when all cone cells are abnormal and inability to distinguish any colors.

When dyschromatopsia is weak, the ability to discriminate red and green may increase by changing colors perceived by dyschromatopsia individuals. Research into applying such method to a display apparatus that displays an image or a video has continued.

SUMMARY OF INVENTION

One or more exemplary embodiments include a display apparatus, a display control apparatus, and a display method capable of displaying an image for dyschromatopsia individuals using a self-emission device without reducing brightness of a display screen.

Additional aspects will be set forth in part in the description which follows and, in part, will be apparent from the description, or may be learned by practice of the presented embodiments.

According to one or more exemplary embodiments, a display apparatus includes a data receiving unit for receiving data of an image that is to be displayed; a driving mode determining unit for receiving dyschromatopsia characteristic information of a user and determining a general driving mode or a dyschromatopsia correction driving mode as a driving mode in correspondence to the dyschromatopsia characteristic information of the user; a data converting unit for converting the data in correspondence to the dyschromatopsia characteristic information of the user to generate corrected data; a memory for storing a reference grayscale used in the general driving mode and one or more correction grayscales used in the dyschromatopsia correction driving mode; a data signal output unit for selecting a grayscale corresponding to the dyschromatopsia characteristic information of the user from among the reference grayscale or the one or more correction grayscales and outputting a data signal corresponding to the data or the corrected data based on the selected grayscale; and a light emissive device for receiving the data signal and emitting light of brightness corresponding to the data signal.

The one or more correction grayscales may have higher brightness values than that of the reference grayscale. The data converting unit may store one or more correction matrixes for converting the data and generate the corrected data from the data by using a correction matrix corresponding to the dyschromatopsia characteristic information of the user among the one or more correction matrixes.

The correction matrix may be an inverse matrix of a Daltonize matrix. The data may comprise RGB data and the data converting unit may generate corrected data from the data by using the following equation:

$$\begin{bmatrix} R_o \\ G_o \\ B_o \end{bmatrix} = \frac{X}{255} \cdot [T] \cdot \begin{bmatrix} R_i \\ G_i \\ B_i \end{bmatrix}$$

wherein X denotes a correction coefficient, T denotes a correction matrix, $R_i$, $G_i$ and $B_i$ denote the data, and $R_o$, $G_o$, and $B_o$ denote the corrected data.

The correction coefficient X may be calculated through the following equation:

$$X = \left| 255 \times \left( \frac{L_{ext}}{L_{max}} \right)^{1/\gamma} \right|$$

wherein $L_{ext}$ denotes a maximum brightness value of the reference grayscale, $L_{max}$ denotes a maximum brightness value of the selected correction grayscale, and $\gamma$ denotes a gamma value.

The dyschromatopsia characteristic information of the user may include information regarding whether the user is a protanomaly user or a deuteranomaly user and a dyschromatopsia degree.

According to one or more exemplary embodiments, a display control apparatus includes a data storing unit for storing data of an image that is to be displayed; a driving mode determining unit for receiving dyschromatopsia characteristic information of a user and determining a general driving mode or a dyschromatopsia correction driving mode as a driving mode in correspondence to the dyschromatopsia characteristic information of the user; a data converting unit for converting the data in correspondence to the dyschromatopsia characteristic information of the user to generate and output corrected data; and a grayscale selection signal output unit for outputting a grayscale selection signal used to select a grayscale corresponding to the dyschromatopsia characteristic information of the user from among a reference grayscale used in the general driving mode and one or more correction grayscales used in the dyschromatopsia correction driving mode.

The data converting unit may store a plurality of correction matrixes for converting the data and generate the corrected data from the data by using a correction matrix corresponding to the dyschromatopsia characteristic information of the user among the plurality of correction matrixes.

According to one or more exemplary embodiments, a display apparatus includes the display control apparatus and a display panel for receiving corrected data and a grayscale selection signal from the display control apparatus and displaying an image corresponding to the corrected data according to the grayscale selection signal, wherein the display panel includes a memory for storing a reference grayscale used in the general driving mode and one or more correction grayscales used in the dyschromatopsia correction driving mode; a data signal output unit for selecting a grayscale corresponding to the dyschromatopsia characteristic information of the user from among the reference grayscale or the one or more correction grayscales and outputting a data signal corresponding to the corrected data based on the selected grayscale; and a light emissive device for receiving the data signal and emitting light of brightness corresponding to the data signal.

According to one or more exemplary embodiments, a display control apparatus includes a data receiving unit for receiving data of an image that is to be displayed; a correction matrix storing unit for storing a plurality of correction matrixes determined based on an inverse matrix of a Daltonize matrix; a corrected data generating unit for receiving dyschromatopsia characteristic information of a user and converting the data by using a correction matrix in correspondence to the dyschromatopsia characteristic information of the user among the plurality of correction matrixes to generate the corrected data; a data signal output unit for outputting a data signal corresponding to the corrected data by using a high brightness mode grayscale; and a light emissive device for receiving the data signal and emitting light of brightness corresponding to the data signal.

The data may comprise RGB data and the corrected data generating unit may convert the data by using the following equation:

$$\begin{bmatrix} R_o \\ G_o \\ B_o \end{bmatrix} = \frac{X}{255} \cdot [T] \cdot \begin{bmatrix} R_i \\ G_i \\ B_i \end{bmatrix}$$

wherein X denotes a correction coefficient, T denotes the inverse matrix of the Daltonize matrix according to the dyschromatopsia characteristic information, $R_i$, $G_i$ and $B_i$ denote the data, and $R_o$, $G_o$, and $B_o$ denote the corrected data.

The correction coefficient X may be calculated through the following equation:

$$X = \left| 255 \times \left( \frac{L_{ext}}{L_{max}} \right)^{1/\gamma} \right|$$

wherein $L_{ext}$ denotes a maximum brightness value according to the dyschromatopsia characteristic information, $L_{max}$ denotes a maximum brightness value of the high brightness mode grayscale, and γ denotes a gamma value.

According to one or more exemplary embodiments, a display method includes receiving data of an image that is to be displayed; receiving dyschromatopsia characteristic information of a user and determining a general driving mode or a dyschromatopsia correction driving mode as a driving mode in correspondence to the dyschromatopsia characteristic information of the user; if the driving mode is determined to be the dyschromatopsia correction driving mode, converting the data in correspondence to the dyschromatopsia characteristic information of the user to generate corrected data; selecting a grayscale corresponding to the dyschromatopsia characteristic information of the user from among a plurality of grayscales including a reference grayscale used in the general driving mode and one or more correction grayscales used in the dyschromatopsia correction driving mode and outputting a data signal corresponding to the data or the corrected data based on the selected grayscale; and displaying a general image or a dyschromatopsia image by using a light emissive device that emits light of brightness corresponding to the data signal.

The one or more correction grayscales may have higher brightness values than that of the reference grayscale. The corrected data may be generated from the data by using a correction matrix corresponding to the dyschromatopsia characteristic information of the user among a plurality of correction matrixes for converting the data.

The data may comprise RGB data and corrected RGB data may be generated from the data by using the following equation:

$$\begin{bmatrix} R_o \\ G_o \\ B_o \end{bmatrix} = \frac{X}{255} \cdot [T] \cdot \begin{bmatrix} R_i \\ G_i \\ B_i \end{bmatrix}$$

wherein X denotes a correction coefficient, T denotes a correction matrix, $R_i$, $G_i$ and $B_i$ denote the data, and $R_o$, $G_o$, and $B_o$ denote the corrected data.

The correction coefficient X may be calculated through the following equation:

$$X = \left| 255 \times \left( \frac{L_{ext}}{L_{max}} \right)^{1/\gamma} \right|$$

wherein $L_{ext}$ denotes a maximum brightness value of the reference grayscale, $L_{max}$ denotes a maximum brightness value of the selected correction grayscale, and γ denotes a gamma value.

The correction matrix may be an inverse matrix of a Daltonize matrix. The dyschromatopsia characteristic information of the user may include information regarding whether the user is a protanomaly user or a deuteranomaly user and a dyschromatopsia degree.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference symbols indicate the same or similar components, wherein:

FIG. 2 is a table illustrating a correction matrix according to an exemplary embodiment;

DETAILED DESCRIPTION OF THE INVENTION

Figure 1:
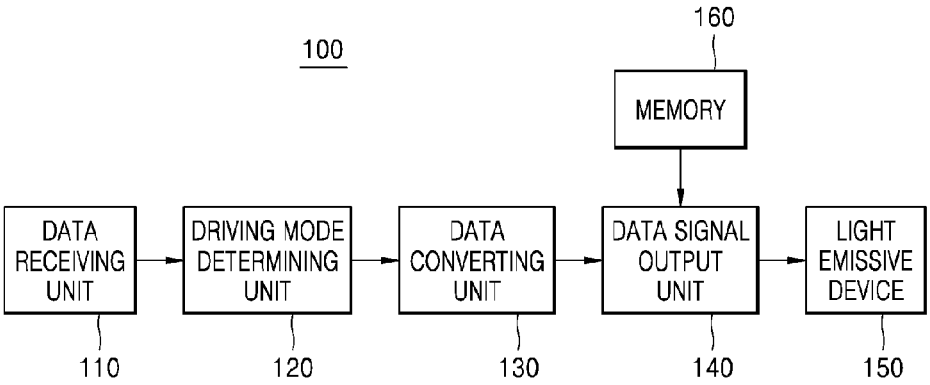
FIG. 1 is a schematic block diagram of a display apparatus according to an exemplary embodiment.

Reference will now be made in detail to exemplary embodiments, examples of which are illustrated in the accompanying drawings, wherein like reference numerals refer to like elements throughout. In this regard, the present exemplary embodiments may have different forms and should not be construed as being limited to the descriptions set forth herein. Accordingly, the exemplary embodiments are merely described below, by referring to the figures, to explain aspects of the present description.

Hereinafter, embodiments of the inventive concept will be described in detail with reference to the accompanying drawings. In addition, in the present specification and drawings, like reference numerals refer to like elements throughout, and thus, redundant descriptions are omitted.

It will be understood that when an element, such as a layer, a region, or a substrate, is referred to as being "on", "connected to" or "coupled to" another element, it may be directly on, connected or coupled to the other element or intervening elements may be present. In contrast, when an element is referred to as being "directly on," "directly connected to" or "directly coupled to" another element or layer, there are no intervening elements or layers present. Other words used to describe the relationship between elements or layers should be interpreted in a like fashion (e.g., "between," versus "directly between," "adjacent," versus "directly adjacent," etc.).

It will be understood that although the terms "first", "second", etc. may be used herein to describe various components, these components should not be limited by these terms. These components are only used to distinguish one component from another. As used herein, the singular forms "a," "an" and "the" are intended to include the plural forms as well, unless the context clearly indicates otherwise. It will be further understood that the terms "comprises" and/or "comprising" used herein specify the presence of stated features or components, but do not preclude the presence or addition of one or more other features or components.

FIG. 1 is a schematic block diagram of a display apparatus 100 according to an exemplary embodiment.

Referring to FIG. 1, the display apparatus 100 according to an exemplary embodiment includes a data receiving unit 110, a driving mode determining unit 120, a data converting unit 130, a data signal output unit 140, a light emissive device 150, and a memory 160.

The data receiving unit 110 may receive data of an image that is to be displayed. The data may include data and the RGB data may be a color coordinate.

That is, the data receiving unit 110 may receive original data of the image that is to be displayed.

The driving mode determining unit 120 may receive dyschromatopsia characteristic information of a user and determine a general driving mode or a dyschromatopsia correction driving mode as a driving mode in correspondence to the dyschromatopsia characteristic information of the user.

Dyschromatopsia individuals may weakly perceive any colors and have a high stimulus threshold value of a color perception, compared to normal individuals. Dyschromatopsia is classified into three types: red-green dyschromatopsia, blue-yellow dyschromatopsia, and complete dyschromatopsia. Red-green dyschromatopsia is weak in perceiving red and green and makes it easy to confuse red and green.

Dyschromatopsia individuals may not exactly determine colors when illumination of a pale face becomes weaker, chroma becomes lower, and size becomes smaller. Protanomaly has a greatly reduced ability of discriminating red and green and perceives a dark red rather than normal. Deuteranomaly has a slightly reduced ability of discriminating red and green but has a same perception level of brightness as that of normal.

Meanwhile, complete achromatopsia refers to a disorder when all cone cells are abnormal and inability to distinguish any colors.

The display apparatus 100, a display control apparatus, and a display method according to exemplary embodiments may be provided for dyschromatopsia individuals, and thus, original image data is appropriately converted so that dyschromatopsia individuals may perceive normal colors.

In particular, a case where dyschromatopsia largely includes protanomaly and deuteranomaly will be described by way of example in the present specification.

The display apparatus 100 may determine driving in the general driving mode or the dyschromatopsia correction driving mode according to the dyschromatopsia characteristic information of the user received by the driving mode determining unit 120.

That is, when the user is a trichromat (normal) individual, the mode may be determined to be the general driving mode, and when the user is a dyschromatopsia individual, the mode may be determined to be the dyschromatopsia correction driving mode.

Meanwhile, the data converting unit 130 may convert the data in correspondence to the dyschromatopsia characteristic information of the user to generate corrected data. The data converting unit 130 may generate corrected RGB data, when the data receiving unit 110 receives RGB data.

If the driving mode determining unit 120 determines driving in the dyschromatopsia correction driving mode, the data converting unit 130 may convert the data received by the data receiving unit 110 by reflecting the dyschromatopsia characteristic information of the user.

The memory 160 may store a reference grayscale used in the general driving mode and one or more correction grayscales used in the dyschromatopsia correction driving mode. The data signal output unit 140 may select a grayscale corresponding to the dyschromatopsia characteristic information of the user from among the reference grayscale or the one or more correction grayscale and output a data signal corresponding to the data or the corrected data based on the selected grayscale.

Therefore, as a result of analyzing the dyschromatopsia characteristic information of the user, the data signal output unit 140 may select the reference grayscale when the user is a trichromat (normal) individual, and select the grayscale corresponding to the dyschromatopsia characteristic information of the user among the one or more correction grayscales when the user is a dyschromatopsia individual.

If the driving mode determining unit 120 determines the general driving mode, the data converting unit 130 may not convert the data or may generate same data as the data received by the data receiving unit 110.

Meanwhile, the data converting unit 130 may store one or more correction matrixes for converting the data and generate the corrected data from the data using a correction matrix corresponding to the dyschromatopsia characteristic information of the user among the one or more correction matrixes.

In particular, the data may comprise RGB data and the data converting unit 130 may generate the corrected RGB data from the RGB data using an equation below.

$$\begin{bmatrix} R_o \\ G_o \\ B_o \end{bmatrix} = \frac{X}{255} \cdot [T] \cdot \begin{bmatrix} R_i \\ G_i \\ B_i \end{bmatrix} \quad \text{[Equation 1]}$$

X denotes a correction coefficient. T denotes a correction matrix. $R_i$, $G_i$ and $B_i$ denote the data. $R_o$, $G_o$, and $B_o$ denote the corrected data.

The correction matrix T may convert the data received by the data receiving unit 110 to emphasize differences between a weakly perceived color and other colors and allow dyschromatopsia individuals to perceive the weakly perceived color and other colors as colors that are perceived by trichromats (normal) individuals.

The corrected data generated by the data converting unit 130 may have a different value from that of the data and that may exceed 255 gray levels. In this case, the value exceeds a range that may be displayed by a display apparatus that uses a general 8-bit driving method, and thus it is necessary to reduce the value of the corrected data at a predetermined rate.

In Equation 1, X/255 acts to reduce a data value generated by a product of the correction matrix T and the data at a predetermined rate.

Because of a characteristic of a grayscale that brightness increases as gray level increases, if the value of the corrected data is reduced, since the corrected data may not be displayed at the originally intended brightness, a grayscale capable of displaying the reduced corrected data at the originally intended brightness may be used. In this regard, the grayscale may be the correction grayscale.

The one or more correction grayscales stored in the memory 160 may have different maximum brightness. The data signal output unit 140 may select a suitable correction grayscale among the correction grayscales according to the dyschromatopsia characteristic information of the user.

That is, when among first and second protanomaly users, a dyschromatopsia degree of the first user is greater than that of the second user, brightness of a color displayed to the first user may be greater than that of a color displayed to the second user.

Meanwhile, the light emissive device 150 may receive the data signal and emit light at brightness corresponding to the data signal, thereby displaying an image corresponding to the data or the corrected data.

FIG. 2 is a table illustrating the correction matrix T according to an exemplary embodiment.

As described with reference to FIG. 1 and Equation 1 above, the data converting unit 130 may provide dyschromatopsia individuals with colors perceived by trichromats using the correction matrix T.

The correction matrix T may be an inverse matrix of a Daltonize matrix. The Daltonize matrix converts the colors perceived by trichromats into colors perceived by dyschromatopsia individuals so that trichromats may indirectly experience colors similar to those seen by dyschromatopsia individuals.

That is, if the Daltonize matrix is applied to color data of an original image, an image converted to a same color as the color perceived by dyschromatopsia individuals may be seen.

The correction matrix T shown in FIG. 2 is the inverse matrix of the Daltonize matrix in which a left matrix is applied to protanomaly, and a right matrix is applied to deuteranomaly. A leftmost column indicates a dyschromatopsia degree that increases from 0.

Thus, the dyschromatopsia degree of 0 means a trichromat. In this regard, although the correction matrix T is used, the data received by the data receiving unit 110 is not changed. As the dyschromatopsia degree is closer to 1, it may be closer to achromatopsia.

As described above, protanomaly individuals have a lower ability of discriminating red and green than that of trichromats individuals. The left matrix applied to protanomaly in the correction matrix T of FIG. 2 changes input data in such a way that protanomaly individuals may easily discriminate red and green.

For example, if it is assumed that data includes 160, 110, and 100, and the dyschromatopsia degree of a protanomaly user is 0.1, the following correction matrix T is applied.

$$\begin{bmatrix} 1.176 & -0.224 & 0.048 \\ -0.036 & 1.054 & -0.018 \\ 0.003 & 0.001 & 0.996 \end{bmatrix}$$

In this case, corrected data generated by the correction matrix T includes 168.32, 108.38, and 100.19.

$$\begin{bmatrix} 1.176 & -0.224 & 0.048 \\ -0.036 & 1.054 & -0.018 \\ 0.003 & 0.001 & 0.996 \end{bmatrix} \times \begin{bmatrix} 160 \\ 110 \\ 100 \end{bmatrix} = \begin{bmatrix} 168.32 \\ 108.38 \\ 100.19 \end{bmatrix}$$

In the data, a difference of R and G values is 50. In the corrected data, a difference of R and G values is 59.94.

Meanwhile, when the data includes 160, 110, and 100, and the dyschromatopsia degree of the protanomaly user is 0.2, the following correction matrix T is applied.

$$\begin{bmatrix} 1.398 & -0.509 & 0.111 \\ -0.079 & 1.117 & -0.037 \\ 0.006 & 0.002 & 0.991 \end{bmatrix}$$

In this regard, the corrected data generated by the correction matrix T includes 178.79, 106.53, and 100.28.

$$\begin{bmatrix} 1.398 & -0.509 & 0.111 \\ -0.079 & 1.117 & -0.037 \\ 0.006 & 0.002 & 0.991 \end{bmatrix} \times \begin{bmatrix} 160 \\ 110 \\ 100 \end{bmatrix} = \begin{bmatrix} 178.79 \\ 106.53 \\ 100.28 \end{bmatrix}$$

In this case, in the corrected data, a difference of R and G values is 72.26.

As a protanomaly degree becomes greater, the ability of discriminating red and green further deteriorates. It is necessary to increase a difference of red and green through the correction matrix T. When in the data, the difference of R and G values is 50, and the dyschromatopsia degrees of the protanomaly user are 0.1 and 0.2 above, in the corrected data, the difference of R and G values respectively increase to 59.94 and 72.26.

Thus, the protanomaly user may easily discriminate red and green on an image displayed through the corrected data.

Although a case where an R value is greater than a G value in the data is described above, a case where the G value is greater than the R value may be applied.

For example, if it is assumed that the data includes 100, 180, and 120, and the dyschromatopsia degree of the protanomaly user is 0.1, the following correction matrix T is applied.

$$\begin{bmatrix} 1.176 & -0.224 & 0.048 \\ -0.036 & 1.054 & -0.018 \\ 0.003 & 0.001 & 0.996 \end{bmatrix}$$

In this case, the corrected data generated by the correction matrix T includes 83.04, 183.96, and 120.

In the data, a difference of R and G values is 80. In the corrected data, a difference of R and G values is 100.92. Thus, a color difference of red and green in the corrected data is greater than that of red and green in the data, and thus the protanomaly user may easily discriminate red and green on an image displayed through the corrected data.

Meanwhile, the correction matrix T of FIG. 2 exemplarily illustrates a plurality of matrixes differently applied according to dyschromatopsia degrees. The dyschromatopsia degrees may be subdivided more than shown in FIG. 2.

Meanwhile, storing different matrixes according to dyschromatopsia degrees may increase memory consumption, and thus a method of reducing the memory consumption may be used by expressing the correction matrix T of FIG. 2 in the following polynomial.

$$\begin{aligned} R_o &= (0.6306 + 0.3884 \times e^{0.3286r}) \times R_i + \\ &\quad (0.4622 - 0.4863 \times e^{0.334r}) \times G_i + \\ &\quad (-0.094 + 0.0991 \times e^{0.3522r}) \times B_i \\ G_o &= (0.0945 + 0.0982 \times e^{0.2743r}) \times R_i + \\ &\quad (0.8465 + 0.1588 \times e^{0.2557r}) \times G_i + \\ &\quad (0.0643 - 0.0657 \times e^{0.2109r}) \times B_i \\ B_o &= (-0.0001 + 0.0305 \times (1 - e^{-0.1266r}) \times R_i + \\ &\quad (-0.0274 + 0.0028 \times e^{0.2702r}) \times G_i + \\ &\quad (1.1663 - 0.1663 \times e^{0.0251r}) \times B_i \end{aligned} \quad \text{[Equation 2]}$$

In equation 2 above, protanomaly degrees from 0 to 6 in the correction matrix T of FIG. 2 are expressed in the polynomial. A variable r may have a value from 0 to 6 as protanomaly degrees.

Meanwhile, deuteranomaly may be expressed in the following polynomial. In equation 3 below, deuteranomaly degrees from 0 to 5 in the correction matrix T of FIG. 2 are expressed in the polynomial. A variable g may have a value from 0 to 5 as deuteranomaly degrees.

$$\begin{aligned} R_o &= (0.5247 + 0.4817 \times e^{0.2799g}) \times R_i + \\ &\quad (0.638 - 0.6465 \times e^{0.2766g}) \times G_i + \\ &\quad (-0.1633 + 0.1654 \times e^{0.2662g}) \times B_i \\ G_o &= (0.1618 - 0.1641 \times e^{0.3009g}) \times R_i + \\ &\quad (0.804 - 0.1988 \times e^{0.3083g}) \times G_i + \\ &\quad (-0.0351 - 0.0356 \times e^{0.3357g}) \times B_i \\ B_o &= (-0.0117 + 0.0119 \times -e^{0.3023g}) \times R_i + \\ &\quad (0.0292 - 0.0296 \times e^{0.2392g}) \times G_i + \\ &\quad (0.9744 + 0.0257 \times e^{0.1405g}) \times B_i \end{aligned} \quad \text{[Equation 3]}$$

The data converting unit 130, as described with reference to FIG. 2 above, may convert the data received by the data receiving unit 110 using the plurality of correction matrix T corresponding to dyschromatopsia degrees, thereby generating corrected data.

The data may be converted by using the polynomials of equations 2 and 3 above, thereby reducing memory consumption necessary for storing the plurality of correction matrix T.

Figure 3:
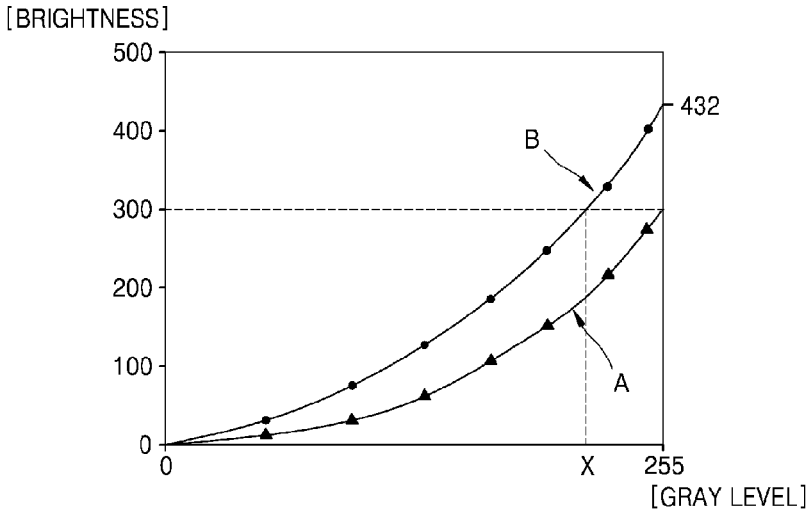
FIG. 3 is a graph illustrating a brightness characteristic of gray levels of a reference grayscale and a correction grayscale according to an exemplary embodiment.

FIG. 3 is a graph illustrating a brightness characteristic of gray levels of a reference grayscale and a correction grayscale according to an exemplary embodiment.

Referring to FIG. 3, a curve A indicates the reference grayscale, and a curve B indicates the correction grayscale. A horizontal axis of the graph of FIG. 3 indicates a gray level, and a vertical axis indicates brightness.

The reference A and the correction B present gray levels from 0 to 255, and respectively have 300 nit and 432 nit as brightness at a maximum gray level of 255, i.e. a maximum brightness of each gray level.

The reference grayscale A may be used in a general driving mode when a user is a trichromat (normal). The correction grayscale B may be used in a dyschromatopsia correction driving mode when a user is a dyschromatopsia individual.

Although the maximum brightness of the correction grayscale B is 432 nit in FIG. 3, this is an example for describing the exemplary embodiment. The maximum brightness of the correction grayscale B may have a different value according to a dyschromatopsia degree.

Although the maximum brightness of the reference grayscale A is 300 nit in FIG. 3, it may have a different value other than 300 nit as necessary.

In the present specification, an operation of data signal output unit 140 is described with reference to FIG. 3. As described above, the reference A is used in the general driving mode and the correction B is used in the dyschromatopsia correction driving mode.

The maximum brightness of the correction grayscale B may have a different value according to a dyschromatopsia degree. As described above, the higher the dyschromatopsia degree, the greater value of the maximum brightness of the correction grayscale B has.

The maximum brightness of the correction B of FIG. 3 is about 432 nit. The correction grayscale B is applied when the dyschromatopsia degree is 0.1.

The maximum brightness of the correction B may be obtained by multiplying a dyschromatopsia correction degree value to the maximum brightness of the reference grayscale A. The dyschromatopsia correction degree value may be the same as a maximum correction value for an R value. The maximum correction value for the R value may be determined as a value having a greatest change rate by comparing input data with its corresponding changed data.

As described with reference to FIG. 2 above, with respect to a protanomaly user, a difference of R and G values further increases in corrected data generated by converting data by applying the correction matrix T.

Thus, according to a value of the data, the corrected data may have a value exceeding a displayable maximum gray level of 255.

For example, when the data includes 255, 180, and 100, and a dyschromatopsia degree of the protanomaly user is 0.1, since 264.36, 182.34, and 100.54 are generated as the corrected data, the difference of R and G values further increases, thereby allowing the protanomaly user to more easily discriminate red and green.

However, since the R value of the corrected data is 264.36 exceeding 255, a correction coefficient for correcting the R value of the corrected data as a value below 255 is necessary.

X in equation 1 above denotes the correction coefficient. The correction coefficient X denotes a gray level value having a maximum brightness value of the reference grayscale A in the correction grayscale B and is obtained through the following equation 4.

$$X = \left| 255 \times \left( \frac{L_{ext}}{L_{max}} \right)^{1/\gamma} \right| \quad \text{[Equation 4]}$$

$L_{ext}$ denotes the maximum brightness value of the reference grayscale A. $L_{max}$ denotes a maximum brightness value of the correction grayscale B. $\gamma$ denotes a gamma value. A case where $\gamma$=2.2 in the present specification will be described below.

The maximum brightness values of the reference grayscale A and the correction grayscale B of FIG. 3 are respectively 300 nit and 432 nit, $\gamma$=2.2, and X is about 216, and thus brightness applied to a gray level of 216 is 300 nit in the correction grayscale B.

If 264.36, 182.34, and 100.54 that are the corrected data described by way of example is applied to equation 1 above, corrected data finally generated by the data converting unit 130 is 223.98, 154.49, and 85.19.

The corrected data (223.98, 154.49, and 85.19) has a smaller value than that of the initially input data (255, 180, and 100). Because of a characteristic of a grayscale that brightness increases as a grayscale increases, if the corrected data (223.98, 154.49, and 85.19) is used, a color may not be displayed at the originally intended brightness, i.e., brightness corresponding to data converted through the correction matrix T.

Therefore, the data signal output unit 140 may select a correction grayscale corresponding to a dyschromatopsia degree from the memory 160 to apply the correction grayscale to the corrected data such that the color may be displayed at the originally intended brightness even if the corrected data is used.

If the correction grayscale B shown in FIG. 3 is applied to the corrected data, a color that may be perceived by the dyschromatopsia individual may be displayed without deteriorating brightness.

A display apparatus, such as a liquid crystal display apparatus, for adjusting brightness using backlight having an invariable maximum brightness uses a method of reducing brightness of colors except for a color having a weak perception, i.e., a method of emphasizing a color having a relatively weak perception, and thus a display screen is problematically dark overall.

The display apparatus 100 according to an exemplary embodiment may flexibly select brightness applied to data converted by a display apparatus that uses a self-emission device such as an organic light-emitting diode (OLED), thereby providing an effect of allowing a dyschromatopsia individual to perceive a color in the same manner as perceived by a trichromat individual without deteriorating brightness.

Figure 4:
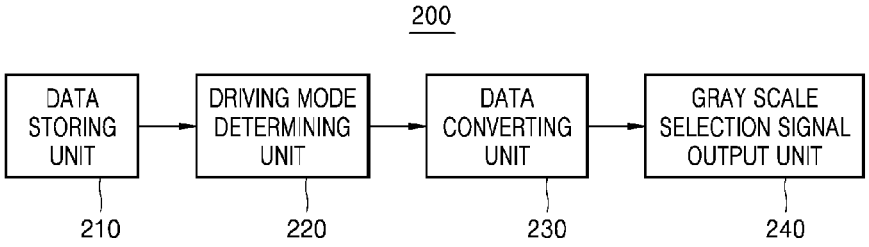
FIG. 4 is a schematic block diagram of a display control apparatus according to an exemplary embodiment.

FIG. 4 is a schematic block diagram of a display control apparatus 200 according to an exemplary embodiment.

Referring to FIG. 4, the display control apparatus 200 according to an exemplary embodiment includes a data storing unit 210, a driving mode determining unit 220, a data converting unit 230, and a grayscale selection signal output unit 240.

The data storing unit 210 may store data of an image that is to be displayed. The data may comprise RGB data and the data may be a RGB color coordinate.

That is, the data storing unit 210 may store original data of the image that is to be displayed.

The driving mode determining unit 220 may receive dyschromatopsia characteristic information of a user and determine a general driving mode or a dyschromatopsia correction driving mode as a driving mode in correspondence to the dyschromatopsia characteristic information of the user.

Therefore, the driving mode determining unit 220 may determine the general driving mode when the user is a trichromat (normal) individual and the dyschromatopsia correction driving mode when the user is a dyschromatopsia individual according to the dyschromatopsia characteristic information of the user.

The data converting unit 230 may convert the data in correspondence to the dyschromatopsia characteristic information of the user to generate and output corrected data.

The gray scale selection signal output unit 240 may output a grayscale selection signal used to select a grayscale corresponding to the dyschromatopsia characteristic information of the user among a reference grayscale used in the general driving mode and one or more correction grayscales used in the dyschromatopsia correction driving mode.

The display control apparatus 200 may perform a function of controlling a display apparatus provided separately from the display control apparatus 200. In particular, the display control apparatus 200 may convert the stored data according to the dyschromatopsia characteristic information of the user in the dyschromatopsia correction driving mode for the dyschromatopsia individual, thereby providing an effect of allowing the user to perceive a color in the same manner as perceived by the trichromat (normal) individual.

To provide the effect, the data converting unit 230 of the display control apparatus 200 may convert the stored data according to the dyschromatopsia characteristic information of the user to output corrected data.

The corrected data may be generated through the data and calculation of a correction matrix. The correction matrix may be an inverse matrix of a Daltonize matrix as described with reference to FIG. 2 above.

Different correction matrixes may be used according to the dyschromatopsia characteristic information of the user, i.e. whether the user is a protanomaly user or a deuteranomaly user, and a dyschromatopsia degree.

Therefore, the data converting unit 230 may store a plurality of correction matrixes for converting the data and generate the corrected data from the data by using a correction matrix corresponding to the dyschromatopsia characteristic information of the user among the plurality of correction matrixes.

The data converting unit 230 may further include a storage unit for storing the plurality of correction matrixes.

The grayscale selection signal output by the gray level selection signal output unit 240 may be a signal that may be recognized by a display apparatus for displaying an image by receiving a signal output from the display control apparatus 200.

The display apparatus may store the reference grayscale used in the general driving mode and the one or more correction grayscales used in the dyschromatopsia correction driving mode. The display apparatus may receive the grayscale selection signal to select the grayscale corresponding to the dyschromatopsia characteristic information of the user among the reference grayscale and the one or more correction grayscales.

The display apparatus may receive the corrected data from the display control apparatus 200 and display an image corresponding to the corrected data based on the grayscale selected by the grayscale selection signal.

Therefore, the display control apparatus 200 may output the corrected data that may be received and recognized by the display apparatus for displaying the image corresponding to the data by using the data, and the grayscale selection signal.

Figure 5:
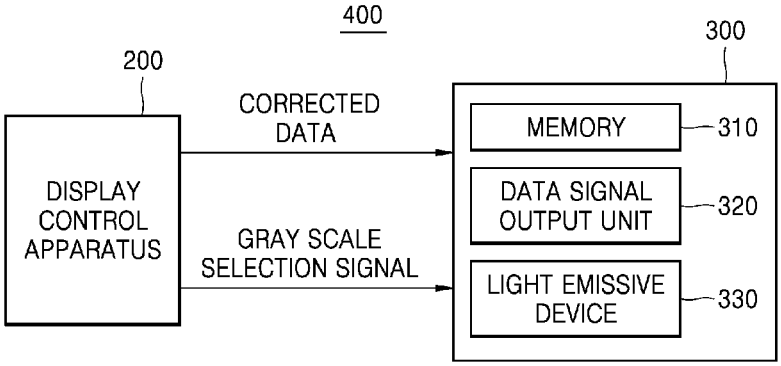
FIG. 5 is a schematic block diagram of a display apparatus according to another exemplary embodiment.

FIG. 5 is a schematic block diagram of a display apparatus 400 according to another exemplary embodiment.

Referring to FIG. 5, the display apparatus 400 according to another exemplary embodiment includes the display control apparatus 200 described with reference to FIG. 4 above and a display panel 300.

The display panel 300 may receive corrected data and a grayscale selection signal from the display control apparatus 200 and display an image corresponding to the corrected data according to the grayscale selection signal.

The display panel 300 includes a memory 310, a data signal output unit 320, and a light emissive device 330.

The memory 310 may store a reference grayscale used in a general driving mode and one or more correction grayscales used in a dyschromatopsia correction driving mode.

As described with reference to FIG. 4 above, the display control apparatus 200 may include a driving mode determining unit 220 that receives dyschromatopsia characteristic information of a user and determines a general driving mode or a dyschromatopsia correction driving mode as a driving mode in correspondence to the dyschromatopsia characteristic information of the user.

If the driving mode is determined as the general driving mode or the dyschromatopsia correction driving mode, a used grayscale may differ according to the determined driving mode. The memory 310 may store a reference grayscale or one or more correction grayscales corresponding to the general driving mode or the dyschromatopsia correction driving mode.

The data signal output unit 320 may output a data signal corresponding to the corrected data based on a grayscale selected from among the reference grayscale or the one or more correction grayscales.

The light emissive device 330 may receive the data signal and emit light of brightness corresponding to the data signal.

The display control apparatus 200 may output the corrected data and the grayscale selection signal. The display panel 300 may receive the corrected data and the grayscale selection signal.

The corrected data is converted from data of an image that is to be displayed according to the dyschromatopsia characteristic information of the user, and, as described with reference to FIG. 2 above, may be generated according to a correction matrix corresponding to the dyschromatopsia characteristic information of the user or a polynomial corresponding to the correction matrix.

The grayscale selection signal is used to select a grayscale corresponding to the dyschromatopsia characteristic information of the user among the reference grayscale or the one or more correction grayscales. The corrected data and the grayscale selection signal commonly correspond to the dyschromatopsia characteristic information of the user.

The corrected data and the grayscale selection signal are generated by the same dyschromatopsia characteristic information, and thus the display panel 300 may output the data signal corresponding to the corrected data based on the grayscale selected by the grayscale selection signal, thereby allowing a dyschromatopsia individual in the dyschromatopsia correction driving mode to perceive a same color as that perceived by a trichromat (normal) individual.

Figure 6:
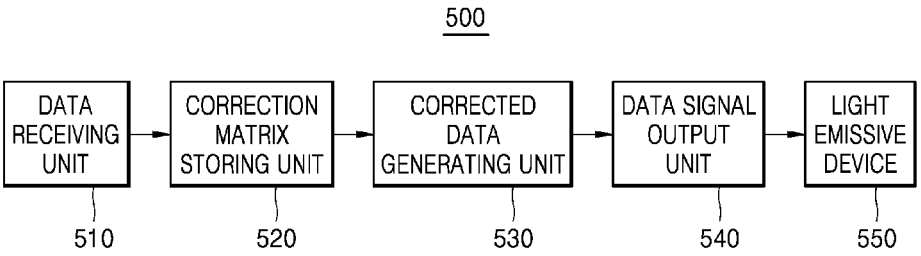
FIG. 6 is a schematic block diagram of a display apparatus according to another exemplary embodiment.

FIG. 6 is a schematic block diagram of a display apparatus 500 according to another exemplary embodiment.

Referring to FIG. 6, the display apparatus 500 according to another exemplary embodiment includes a data receiving unit 510, a correction matrix storing unit 520, a corrected data generating unit 530, a data signal output unit 540, and a light emissive device 550.

The data receiving unit 510 may receive data of an image that is to be displayed. The data may comprise RGB data and the data may be a color coordinate.

The data may be original image data of the image that is to be displayed.

The correction matrix storing unit 520 may store a plurality of correction matrixes determined based on an inverse matrix of a Daltonize matrix. The Daltonize matrix converts a color perceived by a trichromat (normal) individual into a color perceived by a dyschromatopsia individual, and thus, the trichromat individual may indirectly experience a color in a similar way as seen by the dyschromatopsia individual.

Therefore, the correction matrixes may be used to generate converted data to allow the dyschromatopsia individual to perceive a similar color to that seen by the trichromat individual.

The corrected data generating unit 530 may receive dyschromatopsia characteristic information of a user and convert the data by using a correction matrix selected from among the plurality of correction matrixes in correspondence to the dyschromatopsia characteristic information of the user to generate corrected data.

The dyschromatopsia characteristic information may include information regarding whether the user is a protanomaly user or a deuteranomaly user and a dyschromatopsia degree. The corrected data generating unit 530 may select a correction matrix in correspondence to the dyschromatopsia characteristic information and convert the data by the selected correction matrix to generate the corrected data.

The data signal output unit 540 may output a data signal corresponding to the corrected data by using a high brightness mode grayscale. The light emissive device 550 may receive the data signal and emit light of brightness corresponding to the data signal to display an image.

Figure 7:
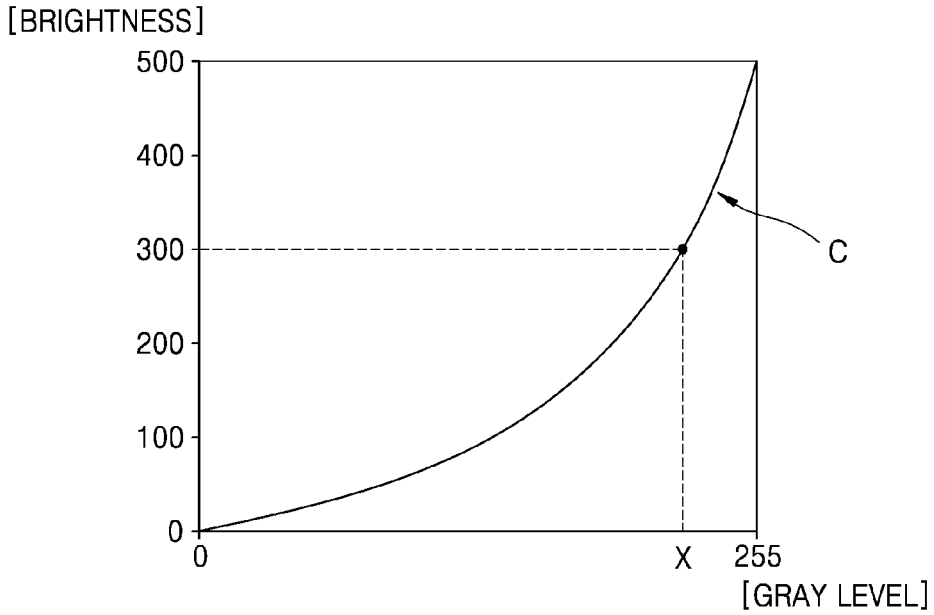
FIG. 7 is a graph illustrating a high brightness mode grayscale used by a display apparatus according to another exemplary embodiment.

FIG. 7 is a graph illustrating a high brightness mode grayscale C used by the display apparatus 500 according to another exemplary embodiment.

Referring to FIG. 7, the high brightness mode grayscale C used by the display apparatus 500 may display 500 nit maximum within a gray level range from 0 to 255, and may be applied when a dyschromatopsia degree is 0.142.

The display apparatuses 100 and 400 and the display control apparatus 200 described with reference to FIGS. 1 through 5 above may use a plurality of correction grayscales corresponding to dyschromatopsia characteristic information of a user, whereas the display apparatus 500 may use only the high brightness mode grayscale C.

Therefore, the high brightness mode grayscale C as shown in FIG. 7 may be used to a user having the dyschromatopsia degree below 0.142.

A different grayscale may not be applied according to the dyschromatopsia degree, and thus a data signal corresponding to the corrected data may be output by differentiating a gray level range used according to dyschromatopsia degrees in the high brightness mode grayscale C.

Meanwhile, a gray level X in the high brightness mode grayscale C indicates brightness of 300 nit and indicates a maximum brightness of the reference grayscale A used in the display apparatuses 100 and 400 according to exemplary embodiments.

Therefore, when the user is determined as a trichromat according to the dyschromatopsia characteristic information of the user, the display apparatus 500 output the data signal corresponding to the corrected data within a gray level range from 0 to X.

The gray level X corresponds to brightness of 300 nit in FIG. 7 but is not limited thereto.

The gray level X may be calculated using the following equation.

$$X = \left| 255 \times \left( \frac{L_{ext}}{L_{max}} \right)^{1/\gamma} \right| \quad \text{[Equation 5]}$$

$L_{ext}$ denotes a maximum brightness value according to the dyschromatopsia characteristic information. $L_{max}$ denotes a maximum brightness value of the high brightness mode grayscale C. $\gamma$ denotes a gamma value. A case where $\gamma=2.2$ in the present specification will be described below.

Referring to FIG. 7, the maximum brightness value according to the dyschromatopsia characteristic information is 300 nit, and the maximum brightness value of the high brightness mode grayscale C is 500 nit, and thus the gray level X is about 202.

Therefore, when the user is the trichromat, the data signal output unit 540 may output a data signal corresponding to the corrected data within a gray level range from 0 to 202.

Meanwhile, the corrected data generating unit 530 may convert RGB data by using the following equation.

$$\begin{bmatrix} R_o \\ G_o \\ B_o \end{bmatrix} = \frac{X}{255} \cdot [T] \cdot \begin{bmatrix} R_i \\ G_i \\ B_i \end{bmatrix} \quad \text{[Equation 6]}$$

X denotes a correction coefficient. T denotes an inverse matrix of a Daltonize matrix according to the dyschromatopsia characteristic information. $R_i$, $G_i$ and $B_i$ denote the data. $R_o$, $G_o$, and $B_o$ denote corrected data.

The inverse matrix of the Daltonize matrix may be a correction matrix stored in the correction matrix storing unit 520 and may be used to convert the data in correspondence to the dyschromatopsia characteristic information of the user.

The correction coefficient X may be a gray level having a maximum brightness value according to the dyschromatopsia characteristic information in the high brightness mode grayscale C and may have a same value as that of the gray level X calculated using equation 5 above.

Therefore, when the user is a trichromat, the correction coefficient X is 202, and the correction matrix selected according to the dyschromatopsia characteristic information of the user is a unit matrix, and thus data converted by the correction matrix have a same value as that of the data.

Therefore, the corrected data generated by the corrected data generating unit 530 has a value by multiplying (202/255) to the data.

A maximum gray level that may be displayed by an 8 bit driving display apparatus is 255, and thus a maximum value of the corrected data does not exceed 202. The data signal output unit 540 may output a data signal corresponding to the corrected data within a gray level range from 0 to 202.

Meanwhile, if the user is a dyschromatopsia individual and a dyschromatopsia degree is 0.1, as described with reference to FIG. 3 above, the gray level X is about 239.

In this case, the corrected data generating unit 530, as described with reference to FIG. 2 above, may select a matrix corresponding to the dyschromatopsia degree of 0.1 and generate the corrected data according to equation 6 above.

In this regard, the data signal output unit 540 may output a data signal corresponding to the corrected data within a gray level range from 0 to 239.

Figure 8:
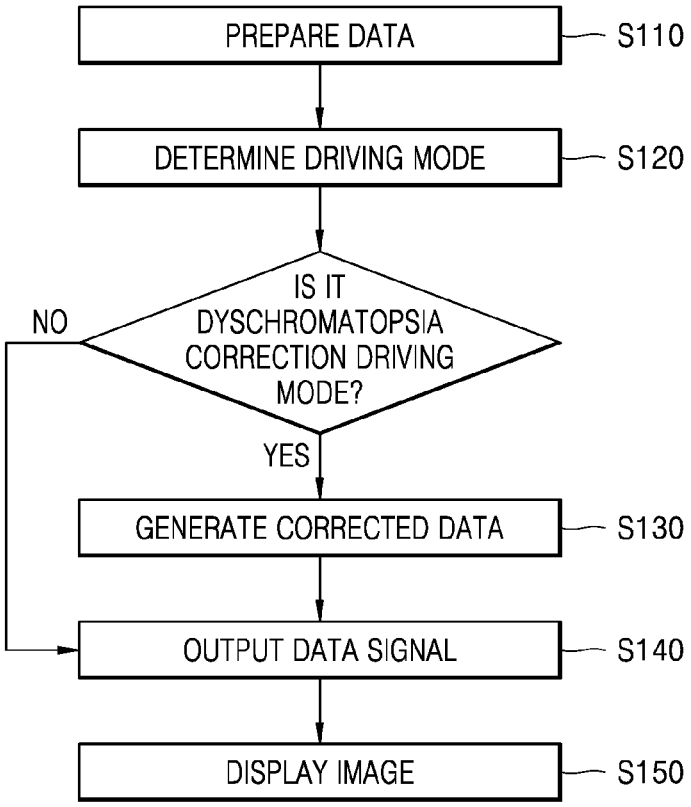
FIG. 8 is a flowchart illustrating a display method according to an exemplary embodiment.

FIG. 8 is a flowchart illustrating a display method according to an exemplary embodiment.

Referring to FIG. 8, the display method according to an exemplary embodiment may include a data preparing operation (S110), a driving mode determining operation (S120), a corrected data generating operation (S130), a data signal output operation (S140), and an image display operation (S150). The data may comprise RGB data.

The data preparing operation (S110) that is an operation of preparing data of an image that is to be displayed may receive original data for displaying a specific image or convert stored data into a state in which the data may be utilized.

The driving mode determining operation (S120) may receive dyschromatopsia characteristic information of a user and determine a general driving mode or a dyschromatopsia correction driving mode as a driving mode in correspondence to the dyschromatopsia characteristic information of the user.

When the dyschromatopsia correction driving mode is determined as the driving mode in the driving mode determining operation (S120), the corrected data generating operation (S130) may convert the data in correspondence to the dyschromatopsia characteristic information of the user and generate corrected data.

The data signal output operation (S140) may select one grayscale corresponding to the dyschromatopsia characteristic information of the user from among a plurality of grayscales including a reference grayscale used in the general driving mode and one or more correction grayscales used in the dyschromatopsia correction driving mode, and may output a data signal corresponding to the data or the corrected data based on the selected grayscale.

When the dyschromatopsia correction driving mode is determined as the driving mode in the driving mode determining operation (S120), as described above, the corrected data may be generated from the data by using a correction matrix corresponding to the dyschromatopsia characteristic information of the user.

To the contrary, when the general driving mode is determined as the driving mode in the driving mode determining operation (S120), since the data is used as it is, the corrected data generating operation (S130) may be omitted, and the data signal corresponding to the data may be output based on the selected grayscale in the data signal output operation (S140).

Finally, the image display operation (S150) may display an image for a general image dyschromatopsia by using a light emissive device that emits light of brightness corresponding to the data signal.

Therefore, when the general driving mode is determined, a general image corresponding to the data and the data signal output based on the reference grayscale may be displayed, and when the dyschromatopsia correction driving mode is determined, a dyschromatopsia image corresponding to the corrected data and the data signal output based on the correction grayscale corresponding to the dyschromatopsia characteristic information of the user may be displayed.

As described above, according to the one or more of the above exemplary embodiments, a display apparatus, a display control apparatus, and a display method capable of displaying an image for dyschromatopsia individuals using a self-emission device without reducing brightness of a display screen may be provided.

It should be understood that the exemplary embodiments described therein should be considered in a descriptive sense only and not for purposes of limitation. Descriptions of features or aspects within each exemplary embodiment should typically be considered as available for other similar features or aspects in other exemplary embodiments.

While one or more exemplary embodiments have been described with reference to the figures, it will be understood by those of ordinary skill in the art that various changes in form and details may be made therein without departing from the spirit and scope as defined by the following claims.

What is claimed is:

1. A display apparatus comprising:

a data receiving unit receiving data of an image to be displayed;

a driving mode determining unit receiving dyschromatopsia characteristic information of a user and determining one of a general driving mode and a dyschromatopsia correction driving mode based on the dyschromatopsia characteristic information of the user;

a data converting unit generating corrected data by converting the data based on the dyschromatopsia characteristic information of the user;

a memory storing a reference gray scale used in the general driving mode and at least one correction gray scale used in the dyschromatopsia correction driving mode;

a data signal output unit selecting a gray scale, based on the dyschromatopsia characteristic information of the user, from among the reference gray scale and the at least one correction gray scale and outputting a data signal corresponding to one of the data and the corrected data based on the selected gray scale; and a light emissive device receiving the data signal and emitting light of brightness corresponding to the data signal, wherein the at least one correction gray scale maps the corrected data to higher brightness value than if the reference gray scale corresponding thereto is used.

2. The display apparatus of claim 1, wherein each of the reference and the at least one correction gray scale is a mapping of gray level pixel image data to brightness, wherein a same grayscale is used to map each of R, G and B pixel image data to a data signal and therefore to brightness.

3. The display apparatus of claim 1, wherein:

the data converting unit stores at least one 3 by 3 correction matrix for converting the data and generates the corrected data from the data by using a correction matrix corresponding to the dyschromatopsia characteristic information of the user among the at least one correction matrix.

4. The display apparatus of claim 1, wherein the generating of the corrected data results in a corrected image being displayed at a reduced brightness if displayed using the reference gray scale as compared to if the received data is not corrected, wherein the outputting of the data signal according to the selected corrected gray scale increases brightness of the corrected image corresponding to the corrected data results than if the reference gray scale is used to result in an original intended brightness when displayed.

5. The display apparatus of claim 3, wherein:

the data comprises data and the data converting unit generates the corrected data from the data by using the following equation:

$$\begin{bmatrix} R_o \\ G_o \\ B_o \end{bmatrix} = \frac{X}{255} \cdot [T] \cdot \begin{bmatrix} R_i \\ G_i \\ B_i \end{bmatrix}$$

wherein

X denotes a correction coefficient,

T denotes a correction matrix, $R_i$, $G_i$, and $B_i$ denote the data, and $R_o$, $G_o$, and $B_o$ denote the corrected data.

6. The display apparatus of claim 1, wherein the dyschromatopsia characteristic information of the user comprises information regarding whether the user is a protanomaly user or a deuteranomaly user and a dyschromatopsia degree, wherein the correction gray scale allows a dyschromatopsia individual to perceive color in a same manner as perceived by a trichromat individual without deteriorating brightness caused by the generating of the corrected data.

7. The display apparatus of claim 1, wherein the corrected data comprises R, G and B corrected data for each pixel, wherein when in dyschromatopsia driving mode, the output data signal corresponds a plurality of R, G and B data signals produced by mapping each of the R, G and B corrected data to corresponding R, G and B image brightness using only a same selected one of the at least one correction gray scales, wherein the selected one of the at least one correction gray scales maps the each of the R, G and B corrected data to a higher respective brightnesses than if the reference gray scale were used instead of the one of the at least one correction gray scales.

8. The display apparatus of claim 1, wherein when in dyschromatopsia correction driving mode, the corrected data comprises R, G and B corrected pixel values for each pixel and the selected gray scale is one of the at least one correction gray scales, the same selected gray scale converts each of the R, G and B corrected pixel values into respective data signals and therefore intensity of illumination of corresponding R, G and B pixels.

9. The display apparatus of claim 1, wherein the selecting of the gray scale is from among the reference gray scale and a plurality of correction gray scales, each of the correction gray scales pertains to a different degree of dyschromatopsia, wherein the correction gray scale for a relatively high degree of dyschromatopsia results in a brighter intensity for a same corrected data than a correction gray scale for a lesser degree of dyschromatopsia.

10. The display apparatus of claim 1, wherein when in dyschromatopsia correction driving mode, the corrected data comprises R, G and B corrected pixel values for each pixel, wherein the same selected gray scale is used to convert each of the R, G and B corrected pixel values into respective R, G and B illumination intensities.

11. A display control apparatus comprising:

a data storing unit storing data of an image to be displayed;

a driving mode determining unit receiving dyschromatopsia characteristic information of a user and determining one of a general driving mode and a dyschromatopsia correction driving mode, based on the dyschromatopsia characteristic information of the user;

a data converting unit generating corrected data by converting the data based on the dyschromatopsia characteristic information of the user and outputting the corrected data; and a gray scale selection signal output unit outputting a gray scale selection signal used to select a gray scale corresponding to the dyschromatopsia characteristic information of the user from among a reference gray scale used in the general driving mode and at least one correction gray scale used in the dyschromatopsia correction driving mode, wherein the at least one correction gray scale maps the corrected data to higher brightness value than if the reference gray scale corresponding thereto is used.

12. The display control apparatus of claim 11, wherein the data converting unit stores a plurality of correction matrixes for converting the data and generates the corrected data from the data by using a correction matrix corresponding to the dyschromatopsia characteristic information of the user among the plurality of correction matrixes.

13. A display apparatus comprising the display control apparatus of claim 11 and a display panel, the display panel:

receiving the corrected data and the gray scale selection signal from the display control apparatus and displaying a corrected image corresponding to the corrected data according to the gray scale selection signal, wherein the display panel comprises a memory:

storing the reference gray scale used in the general driving mode and the at least one correction gray scale used in the dyschromatopsia correction driving mode;

a data signal output unit selecting the gray scale corresponding to the dyschromatopsia characteristic information of the user from among the reference gray scale and the at least one correction gray scale, wherein if the corrected data were displayed as the corrected image using the reference grayscale, a brightness of the resulting corrected image would be less than a brightness of the original image corresponding to the non-corrected data displayed using the reference gray scale, wherein the selected gray scale brightening the corrected image by compensating for a dimming of the corrected image that occurs during the generating of the corrected data so a resultant corrected image processed according to the selected gray scale can be displayed without deteriorating brightness, and outputting a data signal corresponding to the corrected data based on the selected gray scale; and a light emissive device receiving the data signal and emitting light of brightness corresponding to the data signal.

14. A display method comprising:

receiving data of an image to be displayed;

receiving dyschromatopsia characteristic information of a user and determining one of a general driving mode and a dyschromatopsia correction driving mode based on the dyschromatopsia characteristic information of the user;

converting the data based on the dyschromatopsia characteristic information of the user to generate corrected data, when the dyschromatopsia correction driving mode is determined;

selecting a gray scale corresponding to the dyschromatopsia characteristic information of the user from among a plurality of gray scales comprising a reference gray scale used in the general driving mode and at least one correction gray scale used in the dyschromatopsia correction driving mode, and outputting a data signal corresponding to one of the data and the corrected data based on the selected gray scale; and displaying one of a general image and a dyschromatopsia image by using a light emissive device that emits light of brightness corresponding to the data signal, wherein the at least one correction gray scale has brightness values higher than that of the reference gray scale corresponding thereto.

15. The display method of claim 14, wherein the generating of the corrected data results in reduced brightness of the dyschromatopsia image as compared to the received data if displayed without correcting for gray scale, wherein the outputting of the data according to the selected corrected gray scale increases brightness of the dyschromatopsia image corresponding to the corrected data to display the corrected data at an originally intended brightness.

16. The display method of claim 14, wherein the corrected data is generated from the data by using a correction matrix corresponding to the dyschromatopsia characteristic information of the user among a plurality of correction matrixes for converting the data.

17. The display method of claim 16, wherein:

the data comprises data and the corrected data are generated from the data by using the following equation:

$$\begin{bmatrix} R_o \\ G_o \\ B_o \end{bmatrix} = \frac{X}{255} \cdot [T] \cdot \begin{bmatrix} R_i \\ G_i \\ B_i \end{bmatrix}$$

wherein

X denotes a correction coefficient,

T denotes a correction matrix, $R_i$, $G_i$, and $B_i$ denote the data, and $R_o$, $G_o$, and $B_o$ denote the corrected data.

18. The display method of claim 14, wherein the dyschromatopsia characteristic information of the user comprises information regarding whether the user is one of a protanomaly user and a deuteranomaly user and information about a dyschromatopsia degree, wherein the correction gray scale boosts a brightness of the dyschromatopsia image corresponding to the converted data and corrects for a reduction in brightness that occurs during the converting of the data so that the dyschromatopsia image can be displayed at its intended brightness.

19. A display apparatus, comprising:

a data receiving unit:

receiving input data of an image to be displayed;

a correction matrix storing unit storing a plurality of correction matrixes determined based on an inverse matrix of a Daltonize matrix;

a corrected data generating unit:

receiving dyschromatopsia characteristic information of a user and converting the input data by using a correction matrix based on the dyschromatopsia characteristic information of the user among the plurality of correction matrixes to generate corrected data;

a data signal output unit:

outputting a data signal corresponding to the corrected data by using a high brightness mode gray scale; and a light emissive device:

receiving the data signal and emitting light of brightness corresponding to the data signal, wherein the data signal output unit uses predetermined range of gray level according to a dyschromatopsia degree, wherein:

the data comprises data and the corrected data generating unit converts the data by using the following equation:

$$\begin{bmatrix} R_o \\ G_o \\ B_o \end{bmatrix} = \frac{X}{255} \cdot [T] \cdot \begin{bmatrix} R_i \\ G_i \\ B_i \end{bmatrix}$$

wherein

X denotes a correction coefficient,

T denotes the inverse matrix of the Daltonize matrix according to the dyschromatopsia characteristic information, $R_i$, $G_i$, and $B_i$ denote the data, and $R_o$, $G_o$, and $B_o$ denote the corrected data.

20. The display apparatus of claim 19, wherein the correction coefficient X is calculated through the following equation:

$$X = \left| 255 \times \left( \frac{L_{ext}}{L_{max}} \right)^{1/\gamma} \right|$$

where $L_{ext}$ denotes a maximum brightness value according to the dyschromatopsia characteristic information, $L_{max}$ denotes a maximum brightness value of the high brightness mode gray scale, and $\gamma$ denotes a gamma value.

21. A display apparatus, comprising:

a data receiving unit receiving data of an image to be displayed;

a driving mode determining unit receiving dyschromatopsia information to determine a driving mode to drive the display apparatus;

a data converting unit converting the data to dyschromatopsia corrected data based on the dyschromatopsia information; and a data signal output unit selecting a grayscale and outputting a data signal corresponding to one of the data and the dyschromatopsia corrected data to a light emitting device to display the image, wherein when the data signal output unit outputs dyschromatopsia corrected data, the dyschromatopsia corrected data is output based upon a correction gray scale that restores brightness by compensating for brightness and grayscale loss that occurs within the data converting unit.

* * * * *